US011577105B2

(12) United States Patent
Marak et al.

(10) Patent No.: US 11,577,105 B2
(45) Date of Patent: Feb. 14, 2023

(54) BENDABLE HOUSING FOR FALL PROTECTION LOCKING SYSTEM

(71) Applicant: Honeywell International Inc., Morris Plains, NJ (US)

(72) Inventors: Pavel Marak, Brno (CZ); Jan Hrouzek, Brno (CZ); Scott Hugh Bradford, Cumnock (GB); Frank Muessig, Schewarzenbach am Wald (DE); Josef Novotny, Kuncina (CZ)

(73) Assignee: Honeywell International Inc., Morris Plains, NJ (US)

( * ) Notice: Subject to any disclaimer, the term of this patent is extended or adjusted under 35 U.S.C. 154(b) by 421 days.

(21) Appl. No.: 16/833,037

(22) Filed: Mar. 27, 2020

(65) Prior Publication Data

US 2021/0128955 A1 May 6, 2021

Related U.S. Application Data

(60) Provisional application No. 62/929,589, filed on Nov. 1, 2019.

(51) Int. Cl.
*A62B 35/00* (2006.01)
*A62B 35/04* (2006.01)

(52) U.S. Cl.
CPC ..... *A62B 35/0037* (2013.01); *A62B 35/04* (2013.01)

(58) Field of Classification Search
CPC ..... A62B 35/0037; A62B 35/04
See application file for complete search history.

(56) References Cited

U.S. PATENT DOCUMENTS

| | | | | |
|---|---|---|---|---|
| 8,550,225 | B2 * | 10/2013 | Blomberg | F16F 7/128 188/371 |
| 10,449,400 | B2 * | 10/2019 | Roth | A62B 35/0081 |
| 2003/0051944 | A1 | 3/2003 | Shea | |
| 2007/0119653 | A1 | 5/2007 | Brown et al. | |
| 2009/0133977 | A1 * | 5/2009 | Warren | F16F 7/003 188/371 |
| 2011/0011672 | A1 | 1/2011 | Price | |
| 2011/0094839 | A1 * | 4/2011 | Blomberg | A62B 35/04 219/121.72 |

(Continued)

FOREIGN PATENT DOCUMENTS

| | | | |
|---|---|---|---|
| EP | 2581115 | A1 | 4/2013 |
| FR | 2554102 | A1 | 5/1985 |

(Continued)

OTHER PUBLICATIONS

Extended European Search Report issued in Application No. 20202159.8 dated Mar. 31, 2021, 10 pages.

*Primary Examiner* — Anita M King
(74) *Attorney, Agent, or Firm* — Alston & Bird LLP

(57) ABSTRACT

A locking system is provided for fall protection. The locking system includes a housing. The housing defines a guide path through which the housing is slideably attached to a guide member. The locking system also includes a braking lever having a braking end. The braking lever is configured to rotate so as to allow the braking end to engage the guide member. The guide path defines at least one bending slot configured to allow the housing to deform in response to a predetermined amount of force being applied by the guide member upon the housing. A housing for a locking system is also provided.

11 Claims, 21 Drawing Sheets

(56) References Cited

U.S. PATENT DOCUMENTS

| | | | | |
|---|---|---|---|---|
| 2016/0059055 | A1* | 3/2016 | Roth | A62B 35/04 182/36 |
| 2021/0299490 | A1* | 9/2021 | Sulc | A62B 35/0081 |

FOREIGN PATENT DOCUMENTS

| | | | |
|---|---|---|---|
| FR | 2667791 | A1 | 4/1992 |
| WO | 2016/093850 | A1 | 6/2016 |

* cited by examiner

BENDABLE HOUSING FOR FALL PROTECTION LOCKING SYSTEM

CROSS-REFERENCE TO RELATED APPLICATION

This application claims the benefit of U.S. Provisional Application No. 62/929,589, filed Nov. 1, 2019, the content of which is incorporated herein by reference in its entirety.

TECHNOLOGICAL FIELD

An example embodiment relates generally to fall protection systems and, more particularly, to fall protection locking systems.

BACKGROUND

From recreation to survival devices, fall protection devices are instrumental in preserving the safety of users during traversal of uncertain conditions and heights. In order to operate effectively, protection devices must be able to freely travel along a guide member to allow freedom of movement, while also allowing for quick and effective activation of the braking mechanism without damaging the guide member. Applicant has identified a number of deficiencies and problems associated with current fall protection devices. Through applied effort, ingenuity, and innovation, many of these identified problems have been solved by the methods and apparatus of the present disclosure.

BRIEF SUMMARY

The following presents a simplified summary in order to provide a basic understanding of some aspects of the present disclosure. This summary is not an extensive overview and is intended to neither identify key or critical elements nor delineate the scope of such elements. Its purpose is to present some concepts of the described features in a simplified form as a prelude to the more detailed description that is presented later.

In an example embodiment, a locking system is provided for fall protection. The locking system includes a housing. The housing defines a guide path through which the housing is slideably attached to a guide member. The locking system also includes a braking lever having a braking end. The braking lever is configured to rotate so as to allow the braking surface to engage the guide member. The guide path defines at least one bending slot configured to allow the housing to deform in response to a predetermined amount of force being applied by the guide member upon the housing.

In some embodiments, the guide path defines an upper end and a lower end, and the at least one bending slot is positioned proximate to the upper end of the guide path. In some embodiments, in an instance the guide member exerts a predetermined force against the upper end of the guide path, the upper end of the guide path is configured to deform. In some embodiments, the locking system also includes an engagement member configured to restrict the motion of the braking lever in an instance the locking system is in an unlocked position.

In some embodiments, the braking lever further includes a shock absorber configured to dissipate force applied to the locking system. In some embodiments, the shock absorber is configured to permanently deform at a given threshold force. In some embodiments, the shock absorber includes coiled material coupled together with one or more hooks, such that each of the one or more hooks is configured to withstand a predetermined force at which the hook decouples. In some embodiments, the shock absorber includes three hooks configured to operable couple with another portion of the shock absorber, wherein each hook is configured to decouple from the other portion of the shock absorber at different forces.

In another example embodiment, a housing is provided for use in a locking system for fall protection. The housing includes a guide path with an upper end and a lower end. The guide path is configured to be slideably attached to a guide member and the guide path defines at least one bending slot configured to allow the housing to deform at a predetermined amount of force from the guide member.

In some embodiments, the at least one bending slot is positioned closer to the upper end of the guide path than the lower end. In some embodiments, in an instance the guide member exerts a predetermined force against the upper end of the guide path, the upper end of the guide path is configured to deform.

The above summary is provided merely for purposes of summarizing some example embodiments to provide a basic understanding of some aspects of the invention. Accordingly, it will be appreciated that the above-described embodiments are merely examples and should not be construed to narrow the scope or spirit of the invention in any way. It will be appreciated that the scope of the invention encompasses many potential embodiments in addition to those here summarized, some of which will be further described below.

BRIEF DESCRIPTION OF THE DRAWINGS

Figure 1A:
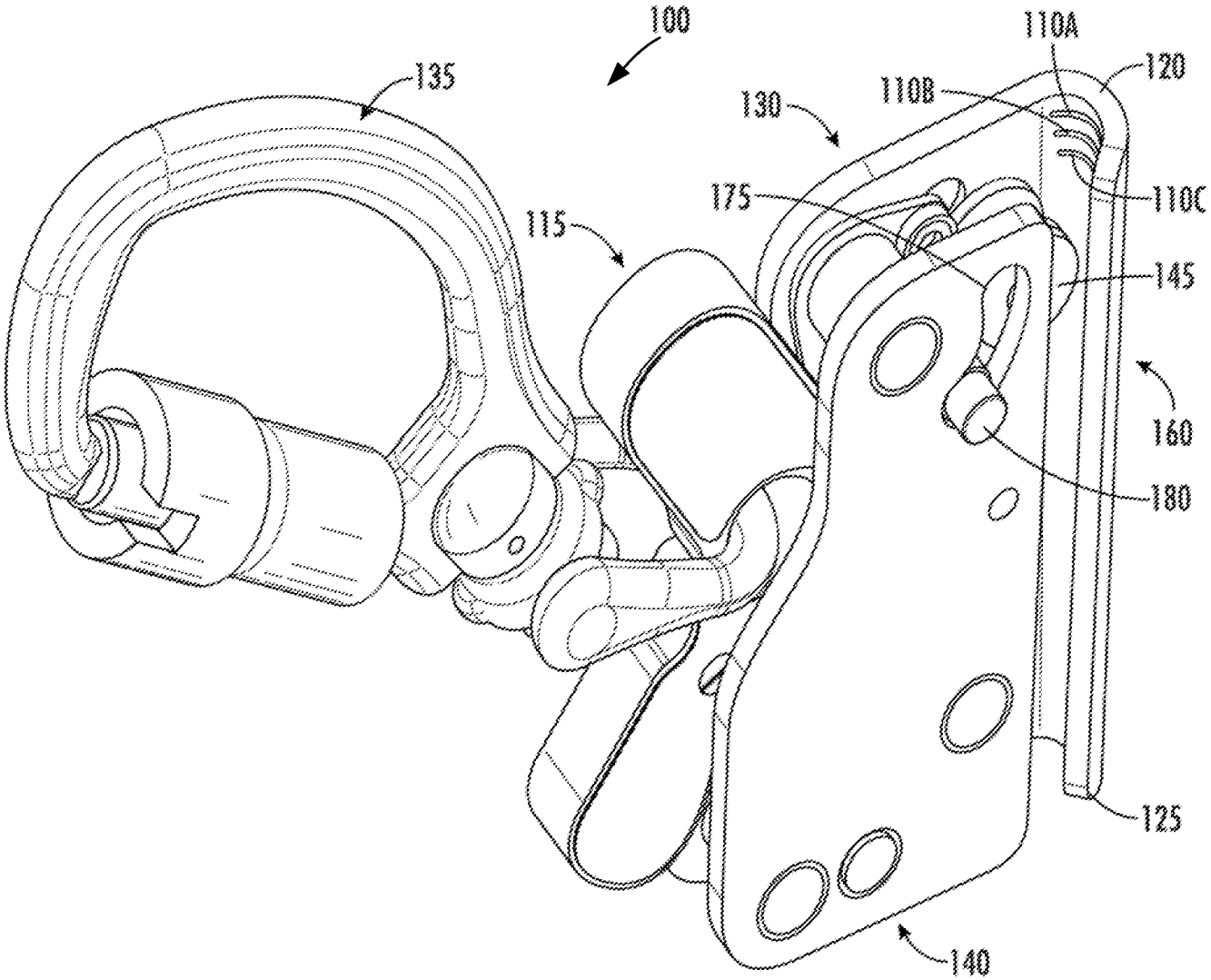
Figure 1B:
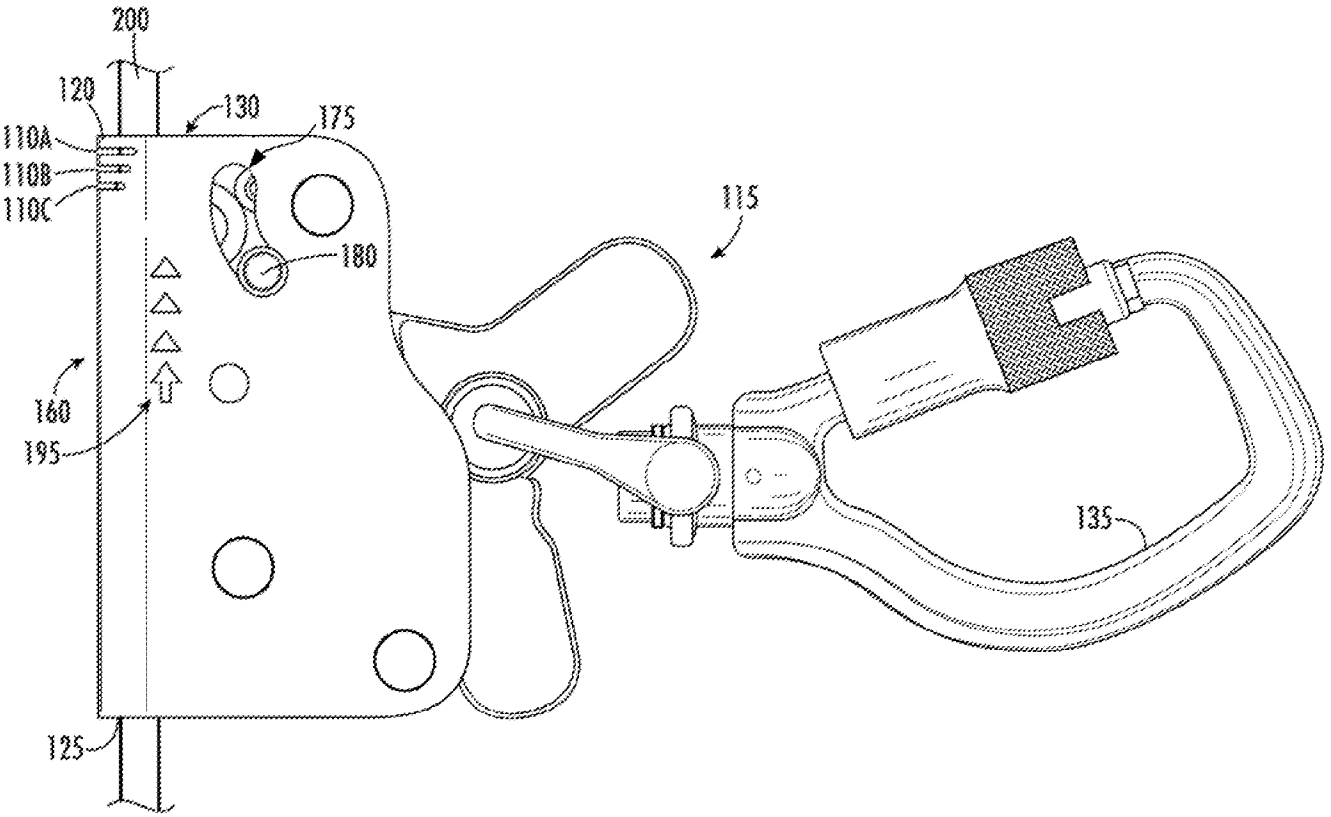
Figure 1C:
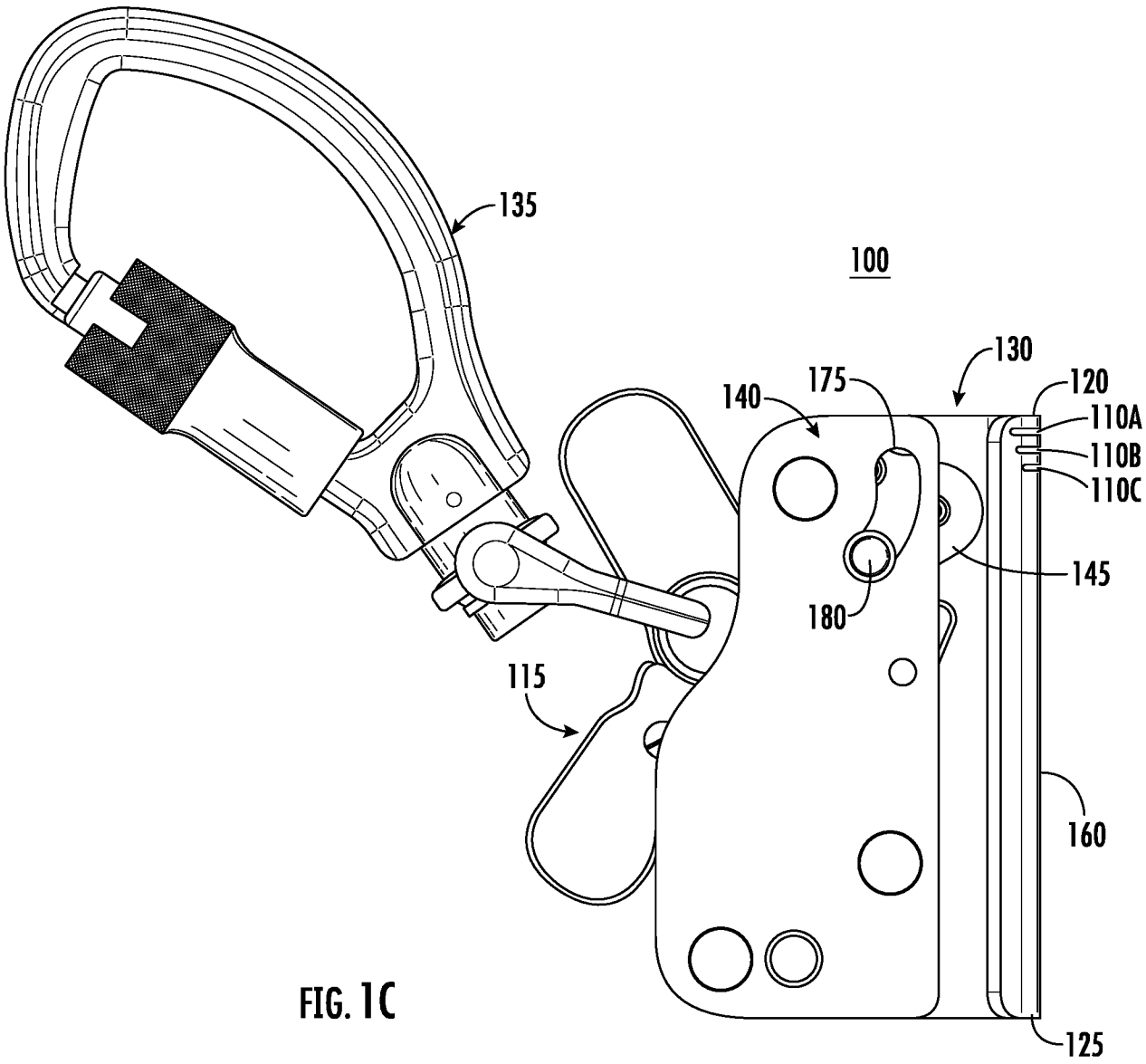
Figure 2A:
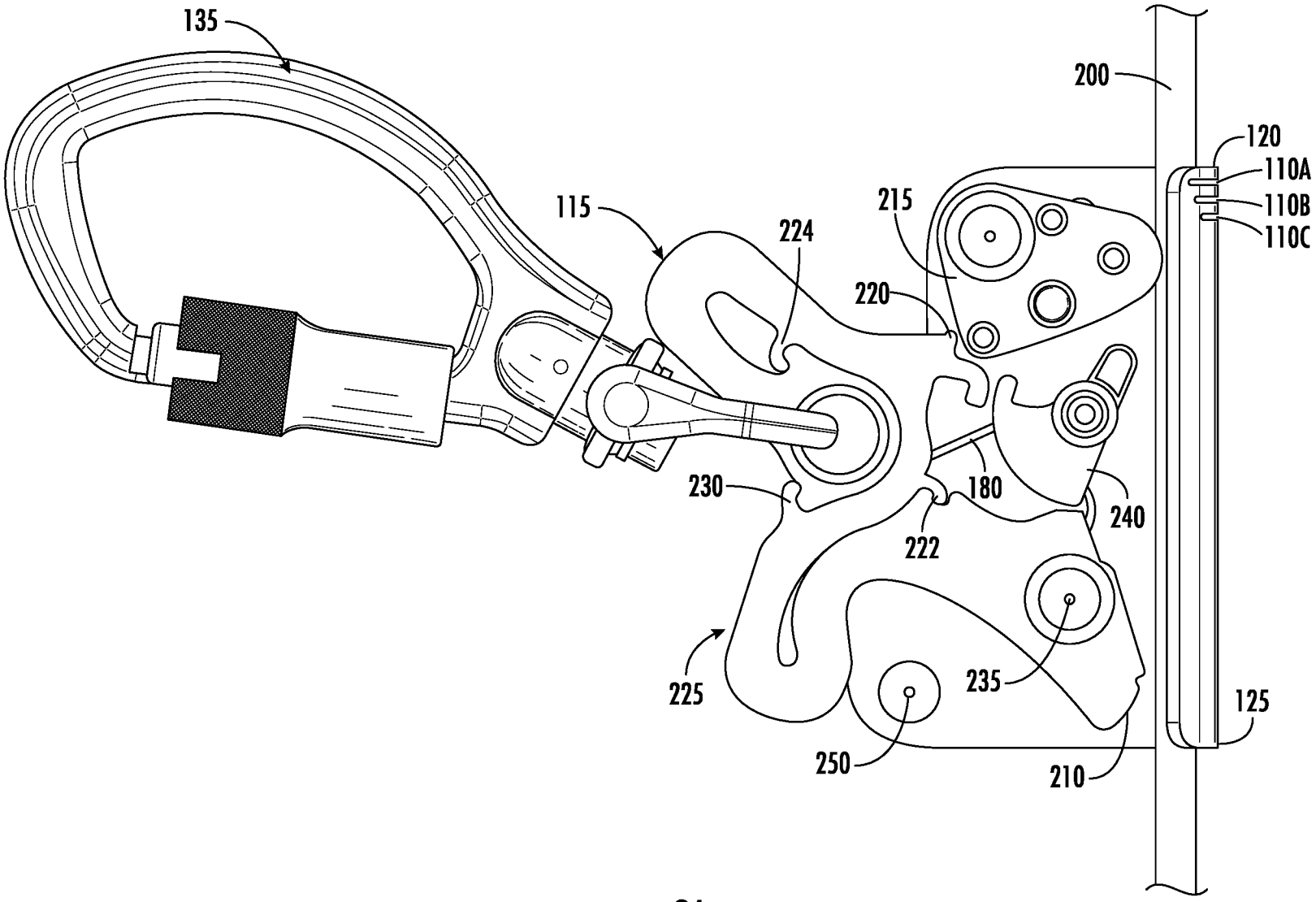
Figure 2B:
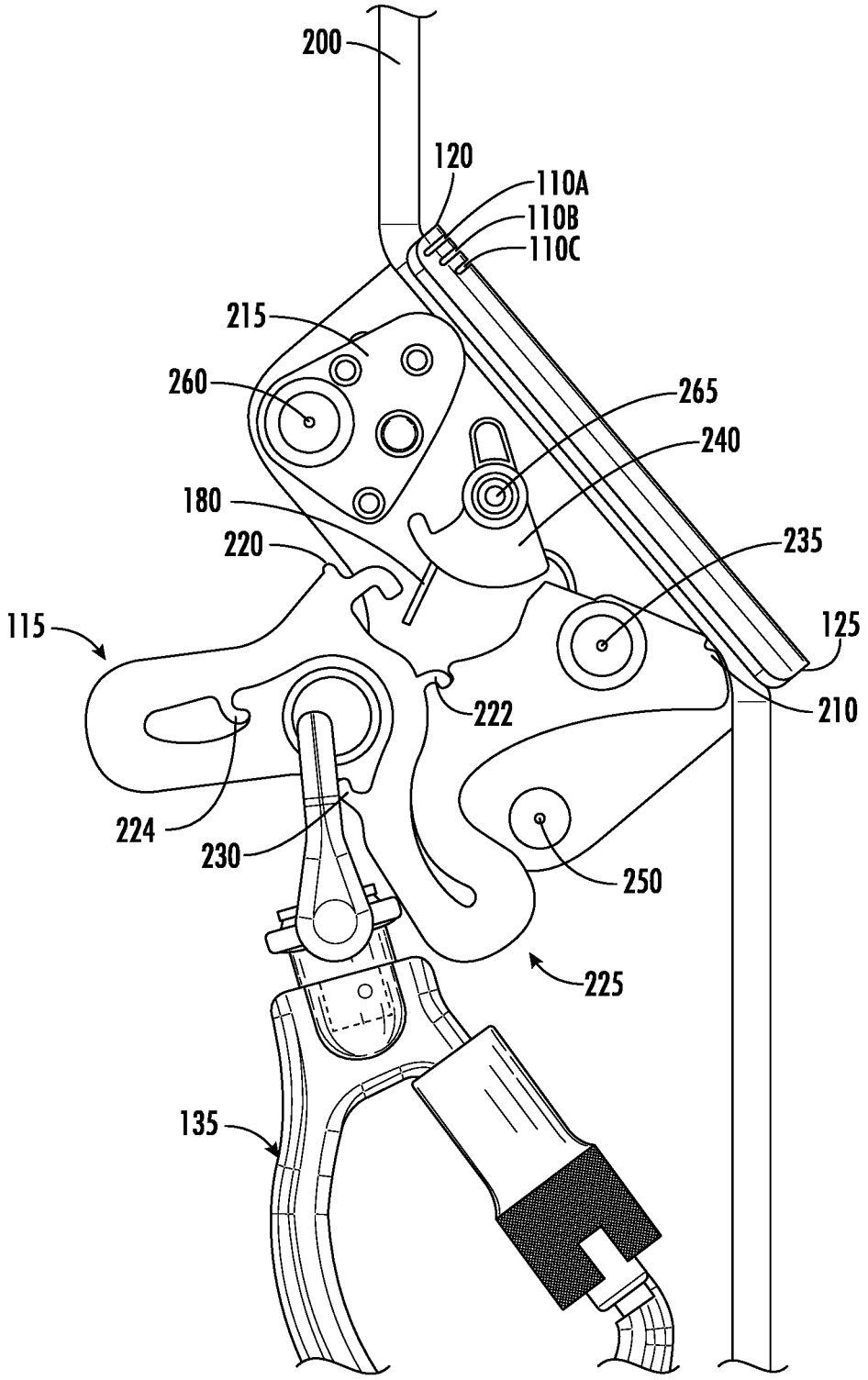
Figure 3:
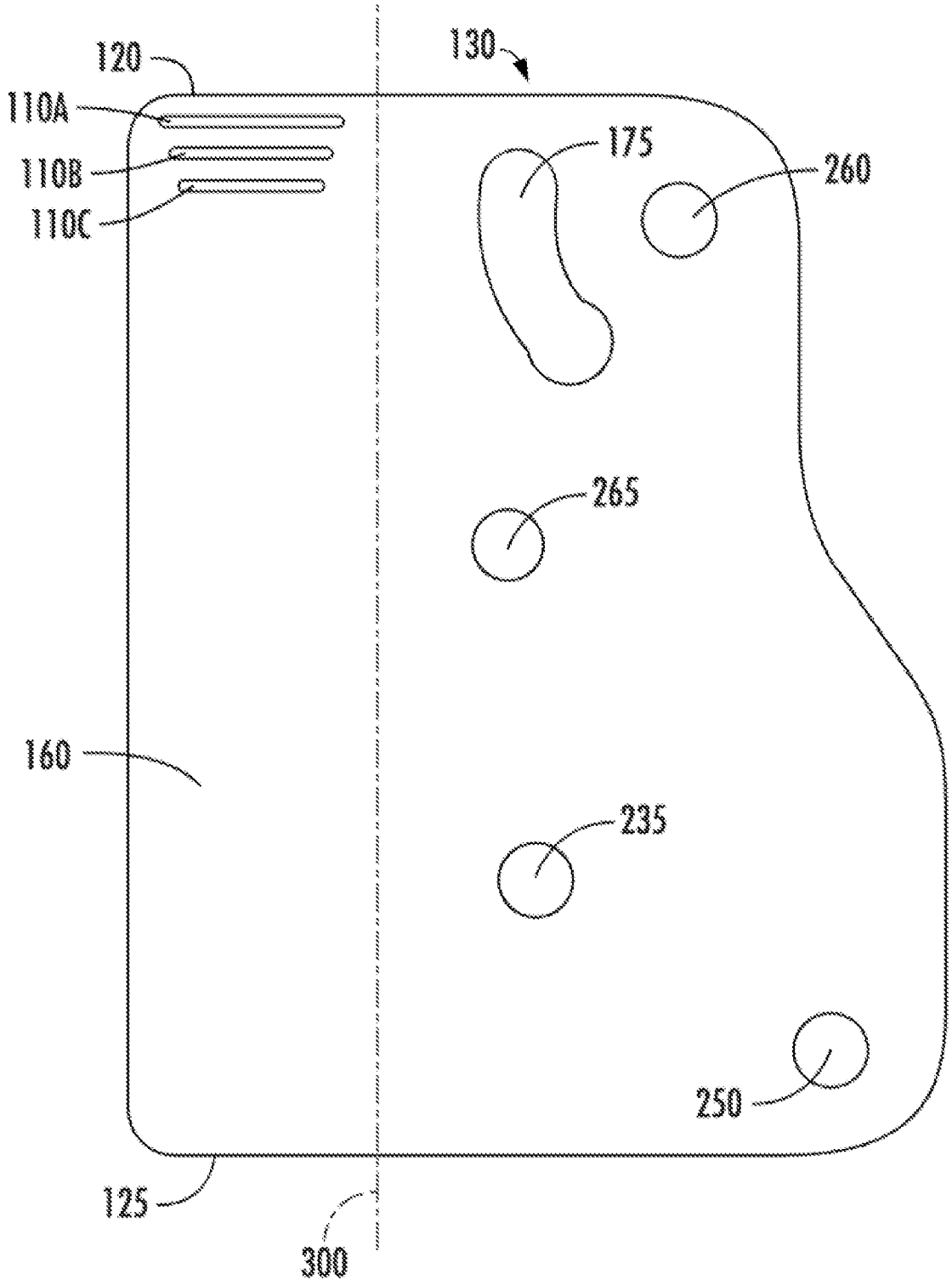
Figure 5:
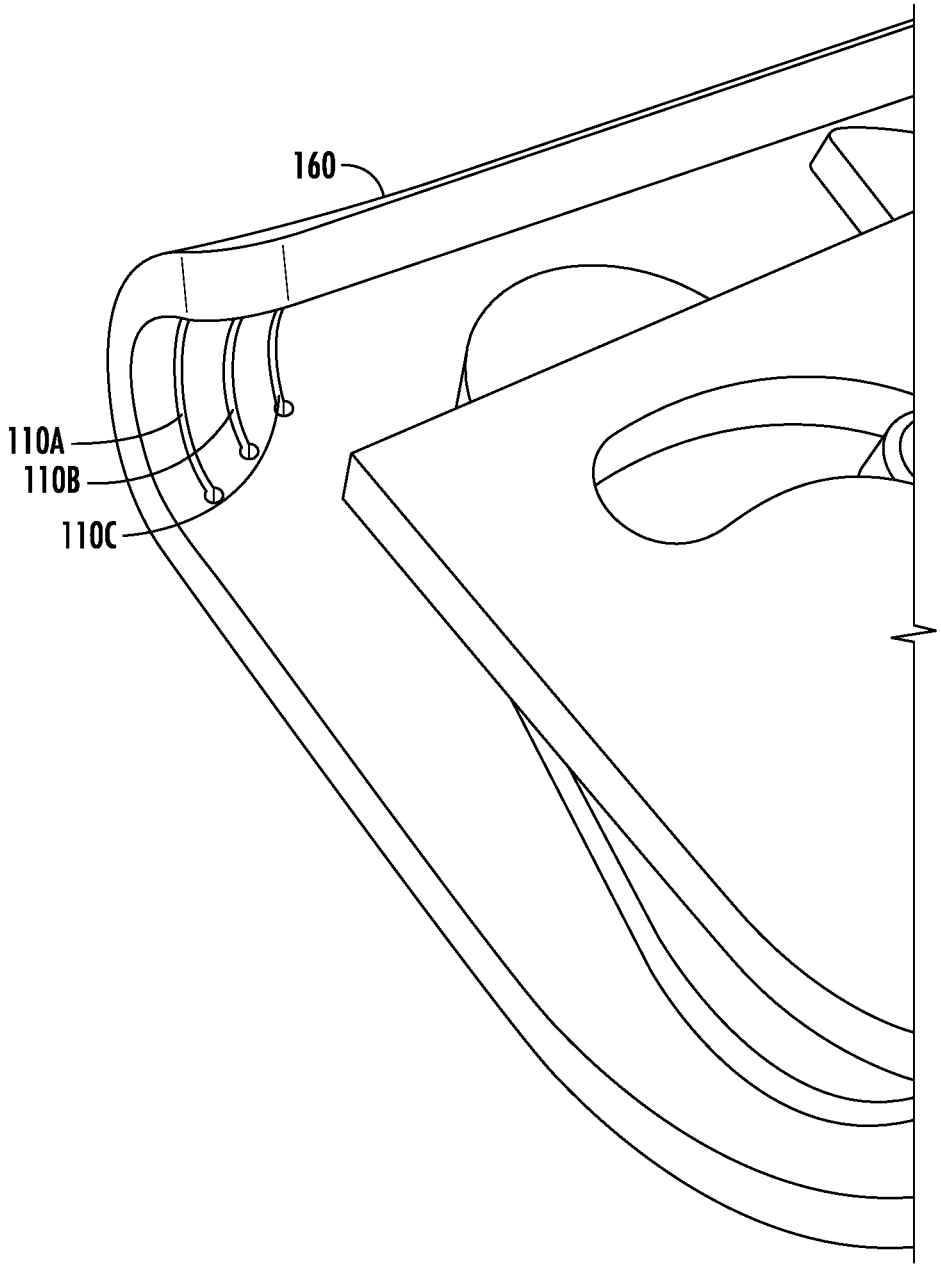
Figure 6:
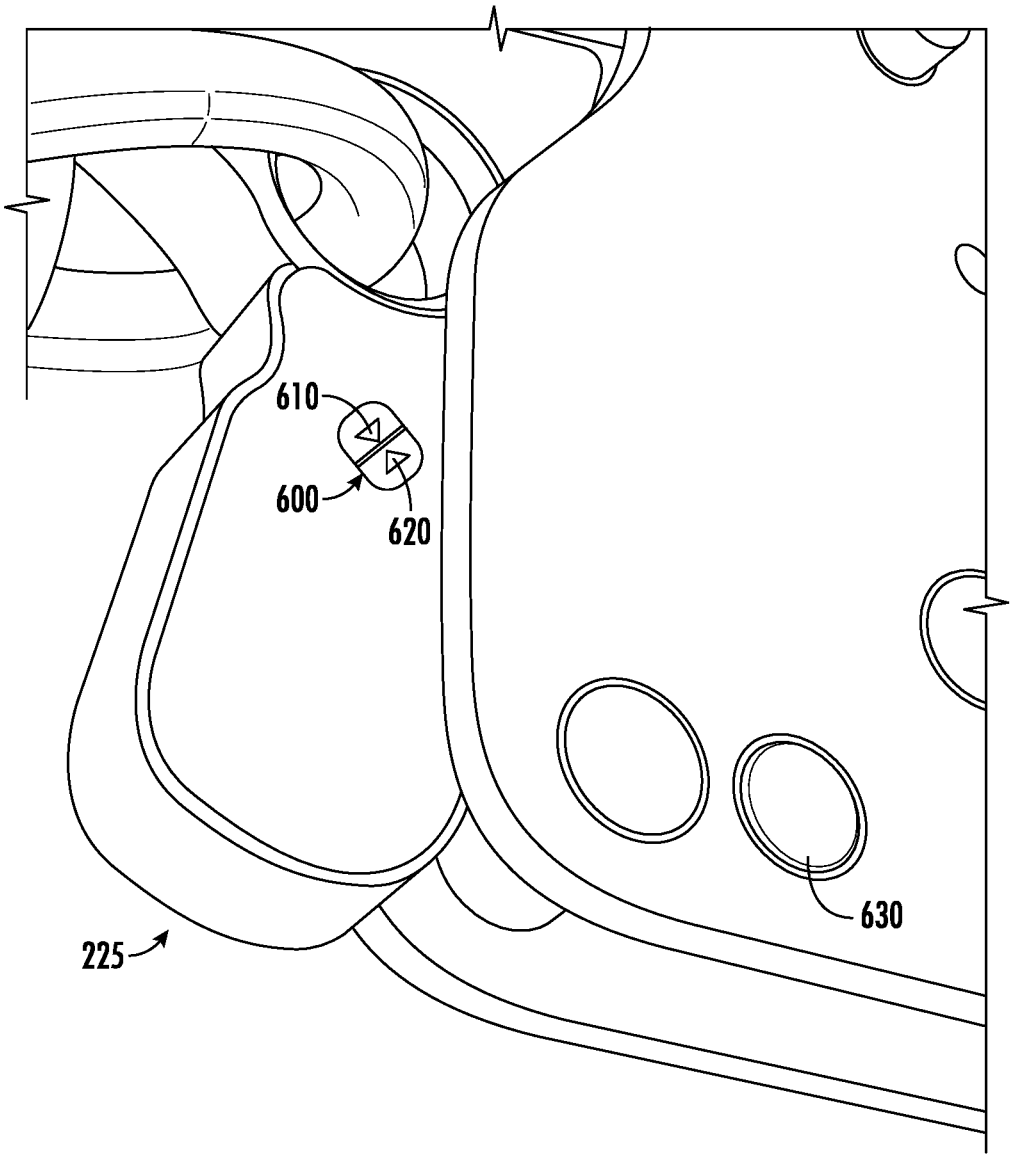
Figure 7:
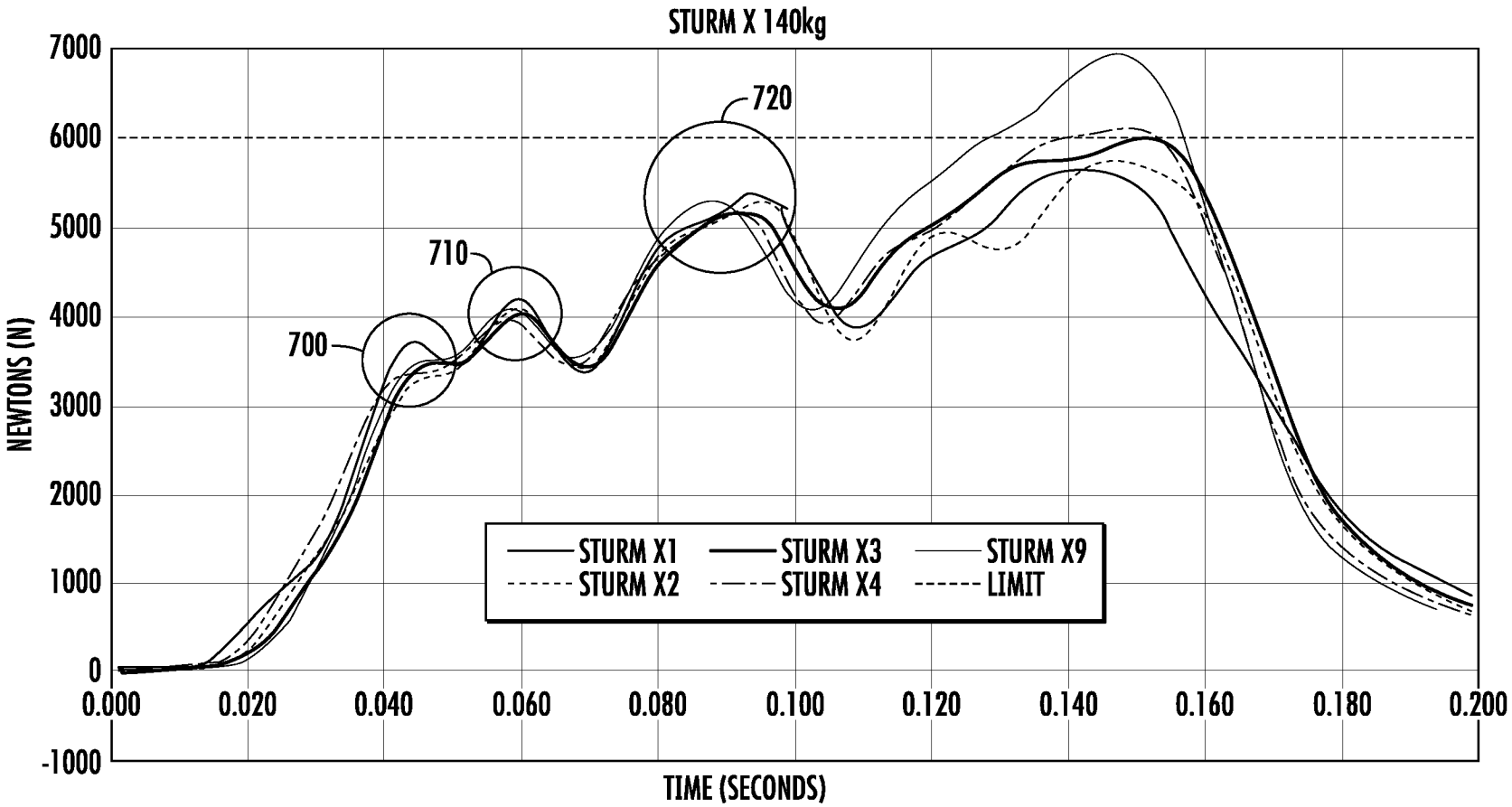
Figure 8A:
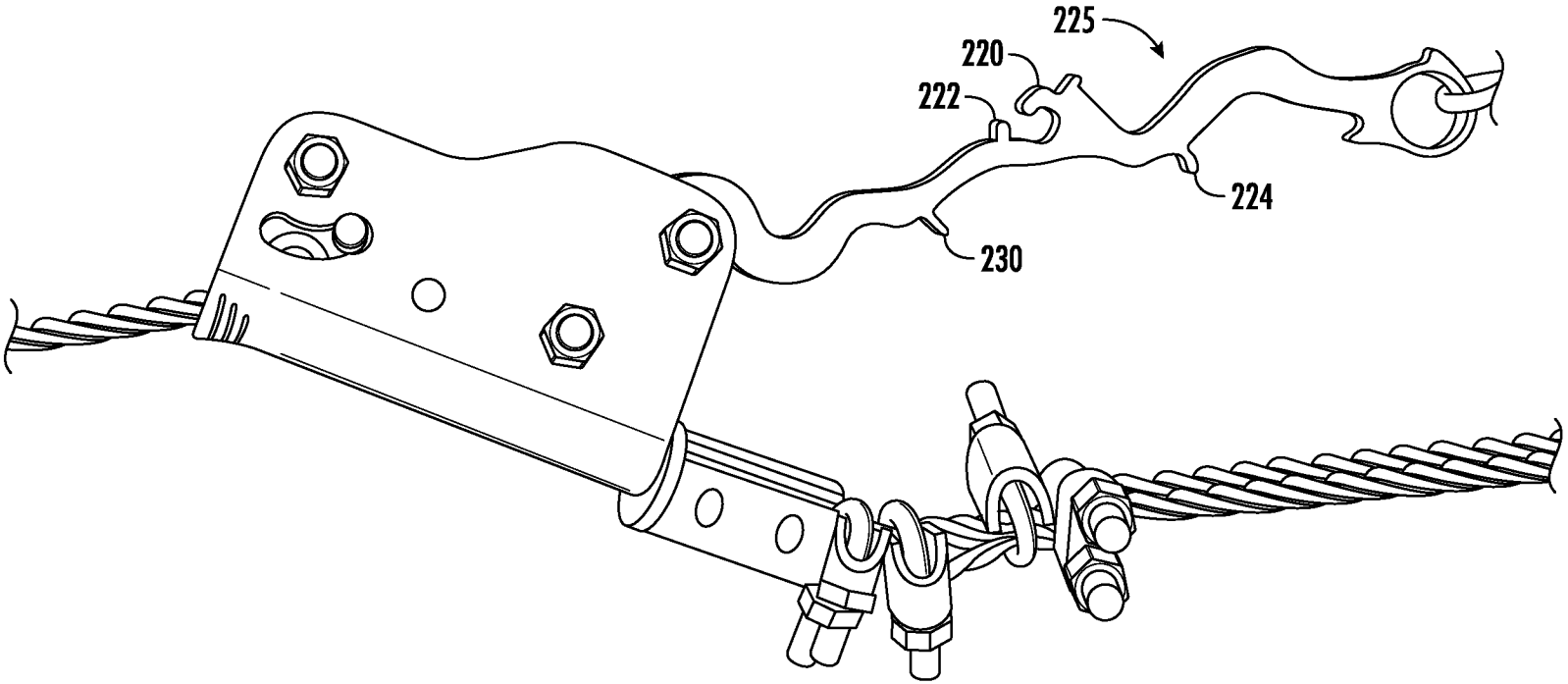
Figure 8B:
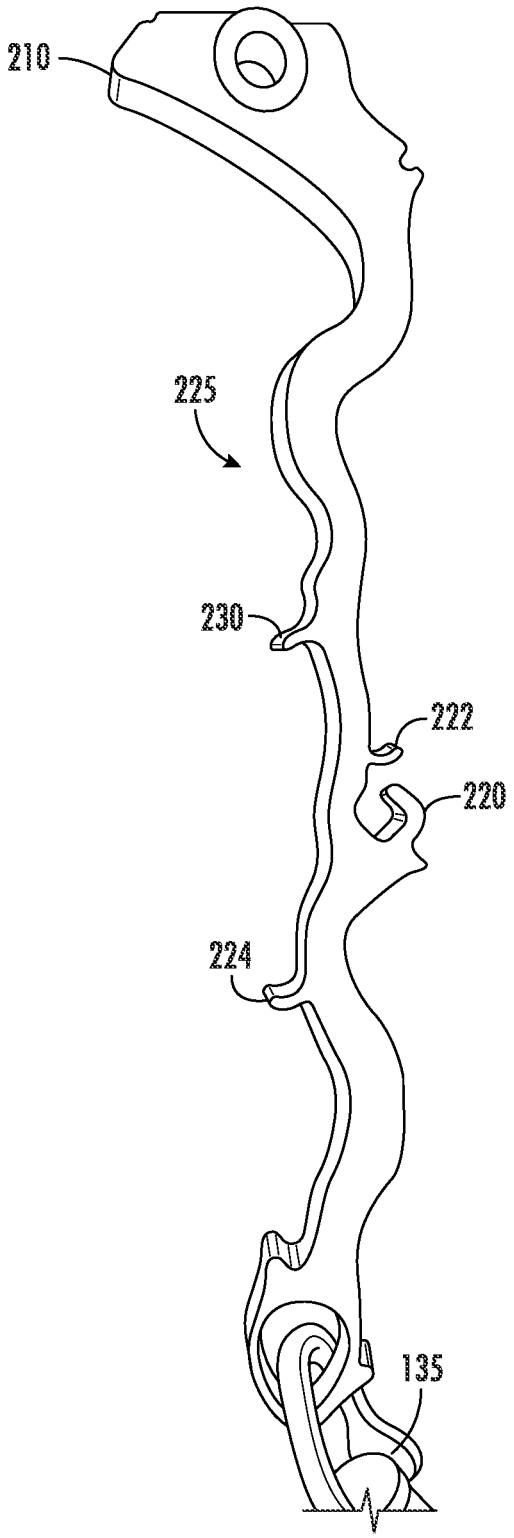
Figure 9A:
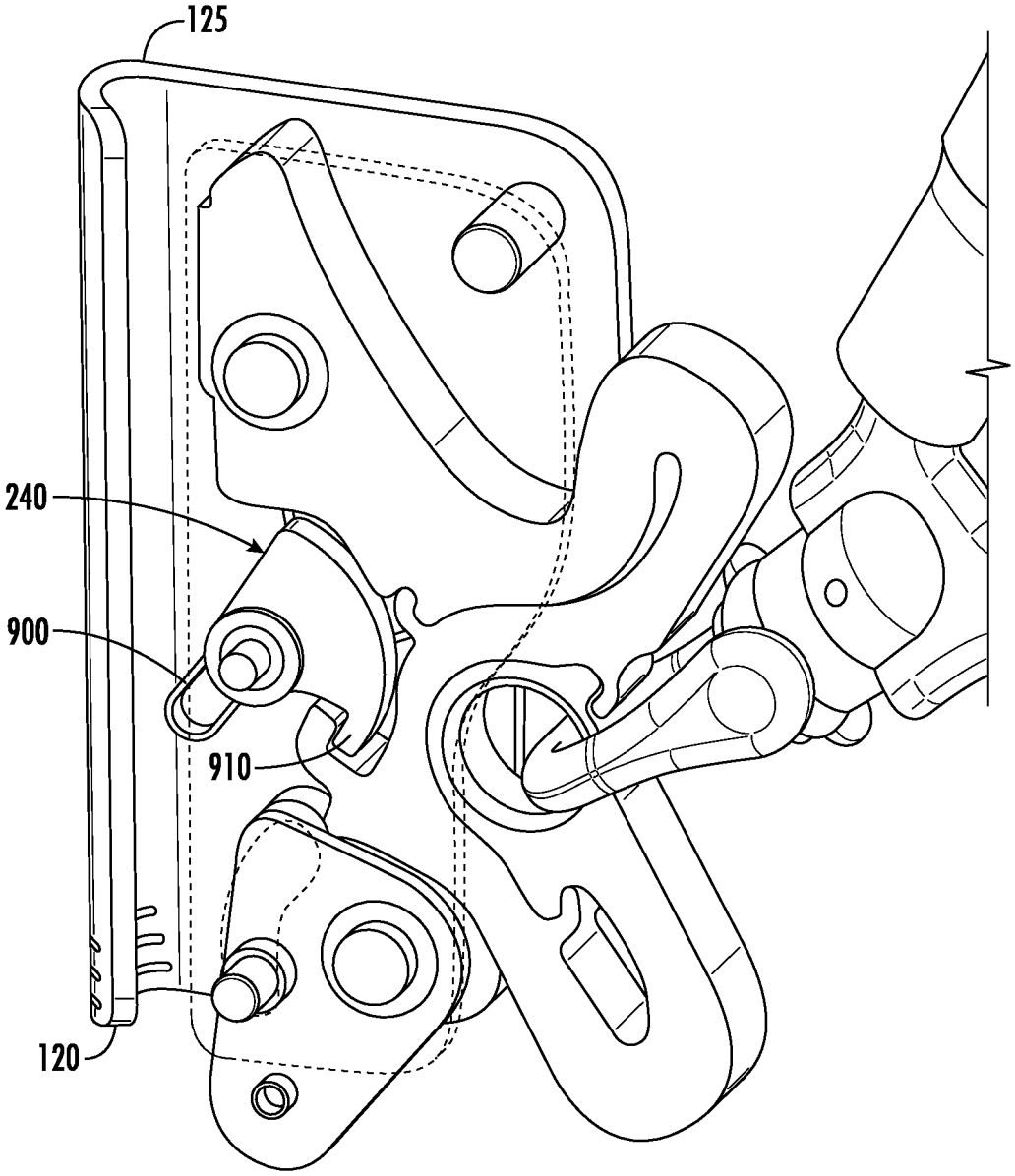
Figure 9B:
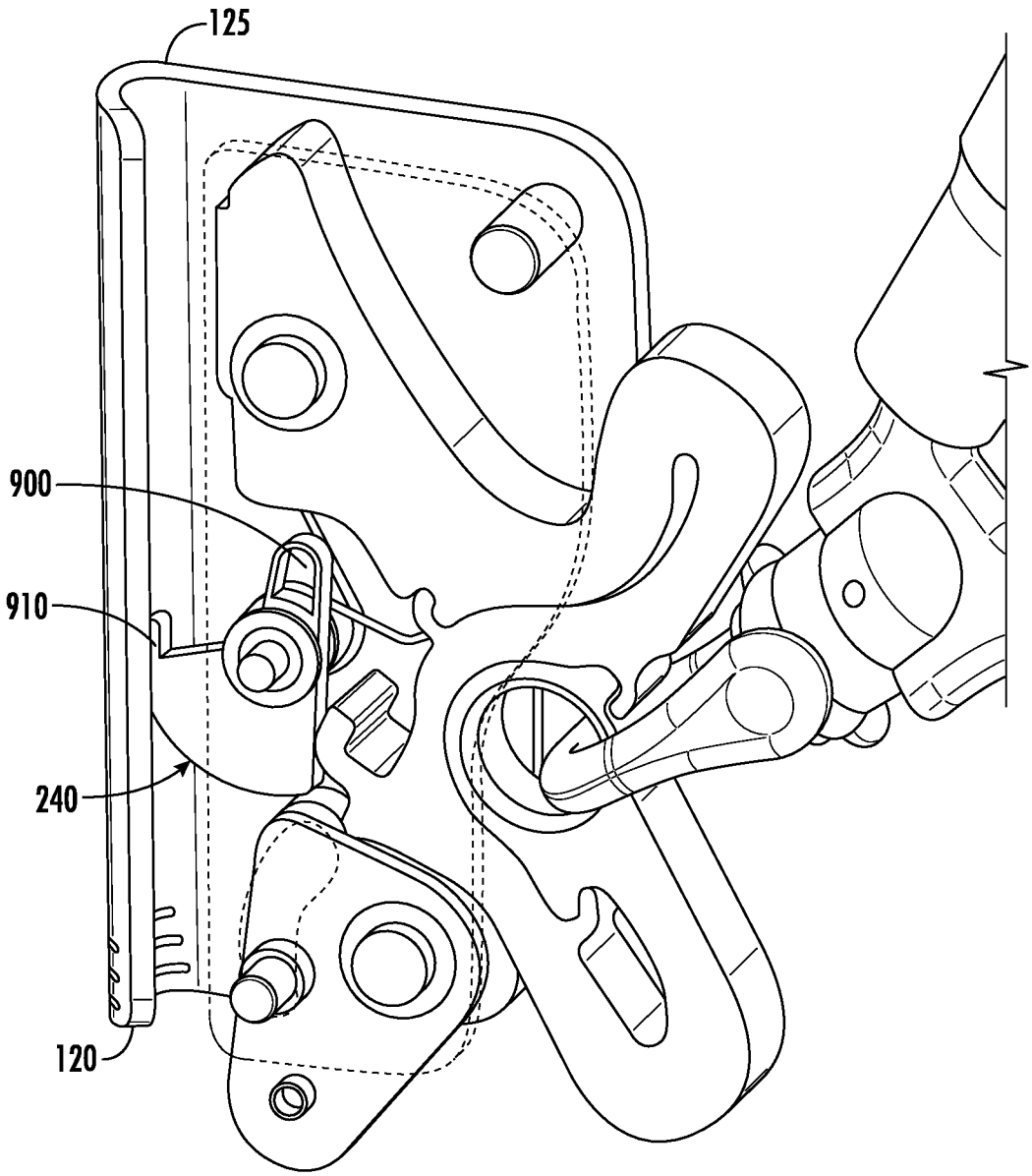
Figure 10A:
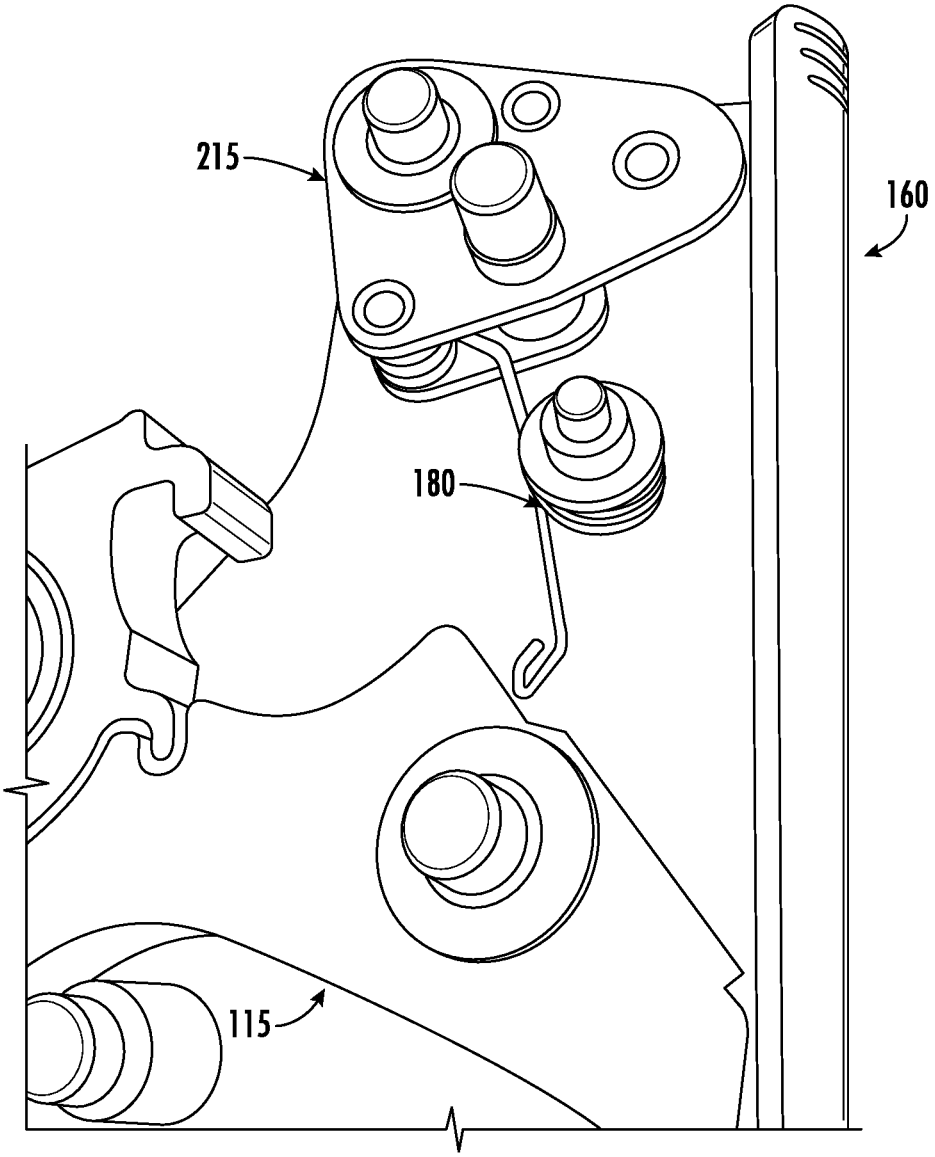
Figure 10B:
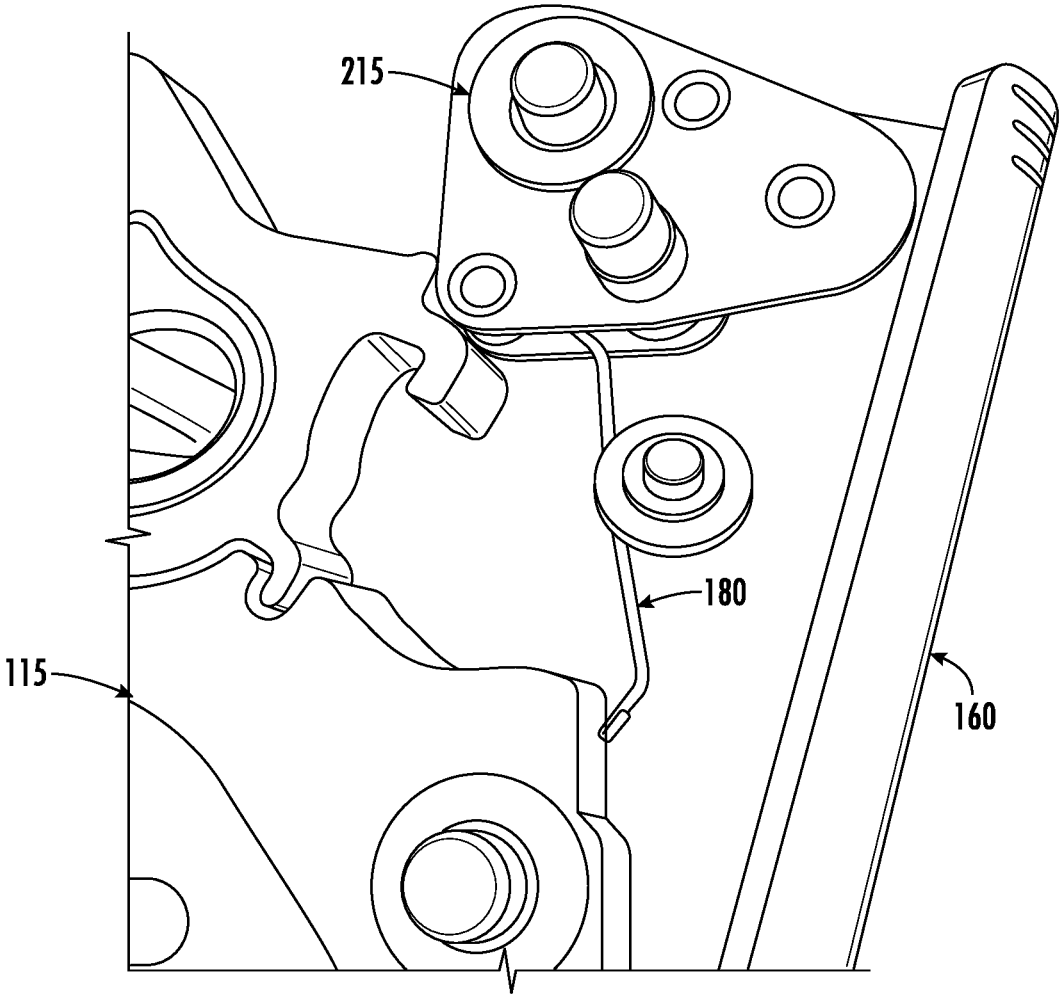
Figure 10C:
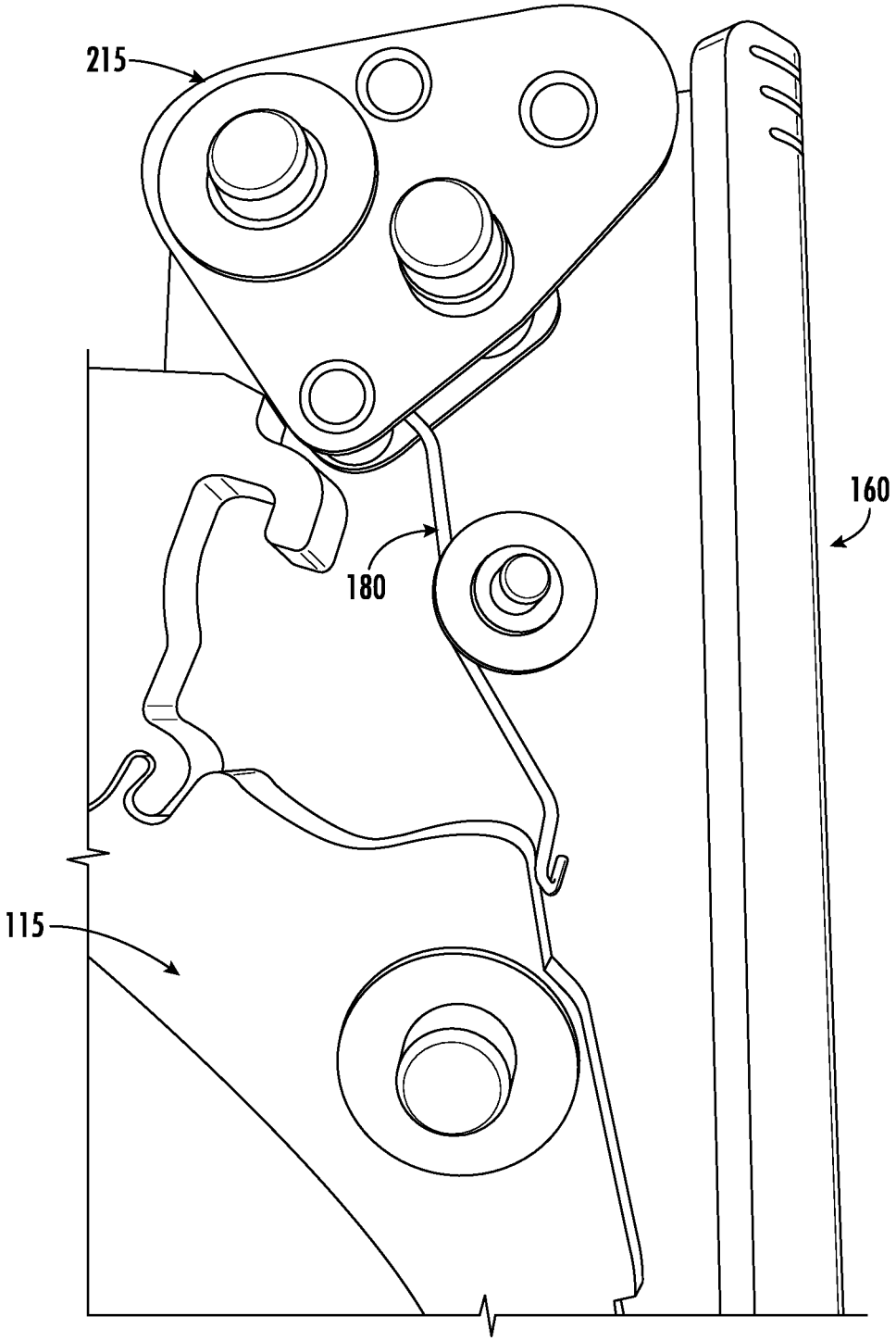

Having thus described certain example embodiments of the present disclosure in general terms, reference will hereinafter be made to the accompanying drawings, which are not necessarily drawn to scale, and wherein:

FIGS. 1A-1C are various exterior view of an example embodiment of a locking system in accordance with the present disclosure;

FIGS. 2A-2B are side views of the internal components of the locking system in the unlocked position (FIG. 2A) and the locked position (FIG. 2B) in accordance with an example embodiment of the present disclosure;

FIG. 3 illustrates a precut housing, such as a laser cut housing, used in a locking system, such as the locking system of FIGS. 1A-1C, before the guide path has been bent in accordance with an example embodiment of the present disclosure;

FIGS. 4A-4E illustrate the deformation of the housing from various amounts of forces during testing of a locking system of an example embodiment;

FIG. 5 illustrates example deformation of the guide path from a fall situation in accordance with an example embodiment;

FIG. 6 illustrates a shock absorber indicator showing that the shock absorber has not been permanently deformed in accordance with an example embodiment;

FIG. 7 illustrates the various deformation points of the shock absorber of an example embodiment during testing of a fall situation with a 140 kilogram load;

FIGS. 8A-8B illustrate permanent deformation of the shock absorber in accordance with example embodiments;

FIGS. 9A-9B illustrate an inversion prevention feature configured to prevent the locking system from being installed inverted on the guide member in accordance with example embodiments; and FIGS. 10A-10C illustrate a spring used to dissipate the rotational motion of the braking lever in accordance with example embodiments.

DETAILED DESCRIPTION

Some embodiments will now be described more fully hereinafter with reference to the accompanying drawings, in which some, but not all, embodiments are shown. Indeed, various embodiments may be embodied in many different forms and should not be construed as limited to the embodiments set forth herein; rather, these embodiments are provided so that this disclosure will satisfy applicable legal requirements. As discussed herein, the protection devices may be referred to use by humans, but may also be used to raise and lower objects unless otherwise noted.

The components illustrated in the figures represent components that may or may not be present in various embodiments of the invention described herein such that embodiments may include fewer or more components than those shown in the figures while not departing from the scope of the invention. Some components may be omitted from one or more figures or shown in dashed line for visibility of the underlying components.

The present disclosure provides various example locking systems to allow for effective operation with improved operation during fall situations. Various embodiments allow for a reduction in force against the guide member, such that the guide member is less likely to be worn and/or break during a fall situation. During an extreme fall situation (e.g., an extended free fall), while the fall arresting device properly exerts a force against the guide member to slow the fall, too much force exerted by the fall arresting device can risk damaging the guide member, or completely cutting the guide member, thereby risking the safety of a user. One such place that the fall arresting device may exert an unintended force is the top of the fall arresting device housing that may provide a direct force to the guide member in certain fall situations. Indeed, in some examples, a sharp edge at the top of the fall arresting device may cut or otherwise weaken the guide member. Various embodiments of the present disclosure allow for the force of the housing on the guide member to be dissipated and therefore reduces the potential harm without requiring additional parts and/or complex machining.

Referring now to FIGS. 1A-1C, various exterior views of the locking system 100 are provided. FIGS. 1B and 1C illustrate opposite side views of the locking system 100, while FIG. 1A illustrates a perspective view of the locking system 100, generally from the same side as FIG. 1C. In various embodiments, the locking system 100 may include a braking lever 115, a housing 130, a connecting portion 135, and a cover plate 140.

In some example embodiments, the housing 130 may be configured with an upper end 120, a lower end 125, a proximal end, and a distal end that is substantially curved such that it defines a guide path 160. The distal end of the housing is sized to slideably receive a guide member (not shown), such as a rope, a cable, and/or the like. In some examples, the distal end is configured to partially surround a guide path 160 whereas in other examples the distal end is configured to completely surround the guide path 160. As discussed in more detail below, the distal end of the housing 130 may have one or more bending slots 110A-C that are cut or otherwise defined near the upper end 120 of the housing 130.

As is shown in FIGS. 1A-1C, the cover plate 140 is positioned opposite to the housing 130 and is configured to cover at least a portion of one or more components of locking system. The cover plate 140 is secured to the housing 130 using one or more bolts, rivets, pins, or the like. For example, the rivets or pins used to hold various locking system components discussed in reference to FIGS. 2A and 2B below may be attached at either end to the housing 130 and the cover plate 140 respectively. In various embodiments, the housing 130 and the cover plate 140 may form a unitary piece. In some embodiments, as shown in FIG. 1B, the external side of the housing 130 may include a orientation indicator 195 configured to indicate the proper installation of the locking system 100 on a guide member 200.

A braking lever 115 is rotatably connected between the housing 130 and the cover plate 140 and comprises two arms that extend outwardly from the proximal end of the housing 130. A connecting portion 135, such as a carabiner, may be securely fastened to the braking lever 115 at an attachment end, such that when a force is applied to the connecting portion 135, the force causes the rotation and deformation of the braking lever 115. The connecting portion 135 is configured to be directly or indirectly connected to a user.

As discussed in more detail below, the locking system 100 may include a guide wheel 145 configured to freely travel along the guide member, such that guide member 200 (shown in FIG. 1B) remains in the guide path 160 during operation. In some embodiments, as shown, the locking system 100 may include an adjustable engagement member slot 175. In various embodiments, the engagement member slot 175 may allow the user to manually move the engagement member via a thumb switch 180 (discussed in FIGS. 2A-2B) into a position to allow a guide member 200 to be inserted into the guide path 160. In some embodiments and in an instance the user engages the thumb switch 180, the engagement member 210 may be moved in order to place the guide member 200 in the guide path 160 by pushing the braking lever 115 in the upward direction (e.g., as the braking lever 115 pushes upward, the thumb switch 180 travels upward along the engagement member slots 175. As is shown in FIGS. 1A-1C, the engagement members slot 175 may be curved and may be defined by both the housing 130 and the cover plate 140, such that the engagement member slot 175 on the housing 130 is a mirror image of the engagement member slot 175 on the cover plate 140 and the engagement member slots 175. In various embodiments, the engagement member slot 175 on the housing 130 and the engagement member slot 175 on the cover plate 140 may complement one another, such that the thumb switch 180 may travel along the engagement member slots 175 on both the housing 130 and the cover plate 140 (e.g., the thumb switch 180 may be generally perpendicular to the housing 130 and the cover plate 140 during operation).

FIG. 2A illustrates a view of the locking system 100 with the cover plate 140 removed. As shown, the locking system 100 includes at least a braking lever 115, an engagement member 215, and rotation resistance member 250. In various embodiments, the locking system 100 may move between a unlocked position (as is shown in FIG. 2A), wherein the locking system 100 travels along the guide member 200 with minimal resistance, and a locked position (as is shown in FIG. 2B), wherein the locking system 100 (e.g., the braking end 210 of the braking lever 115) engages with the guide member to restrict and/or stop motion of the locking system 100 along the guide member 200. In some embodiments, the locking system 100 may be configured to, in the locked position, allow the locking system 100 to be moved (e.g., by a user) relative to the guide member 200 in an instance the thumb switch 180 is engaged (e.g., the user pressed the thumb switch 180 on both the housing 130 side and the cover plate 130 side. In some embodiments, the locking system 100 may also have a guide member installation position, wherein the guide member 200 may be placed into or removed from the guide path 160 (e.g., the engagement member 215 and the braking lever 115 do not obstruct the guide path 160, such that a guide member may be installed within and/or removed from the guide path 160).

As shown in FIG. 2A, in the unlocked position, the engagement member 215 may be engaged with the braking lever 115 to restrict the braking lever 115 from rotating about the braking center of rotation 235. For example, the braking lever 115 may have a restriction portion 220 configured to engage with the engagement member 215 so to prevent the braking lever 115 from transitioning to a locked position absent a threshold force. For example, as shown the restriction portion 220 may be configured to engage with a plurality of protrusions configured to keep the engagement between the restriction portion 220 and the engagement member 215.

In some examples, the braking lever 115 may be configured with a plurality of pins or other coupling mechanisms that are operably coupled together during typical operation. As shown by coupling points (e.g., hooks 222, 224, and 230), the braking lever 115 may be coiled and/or bent in such a way that the in an instance in which a force upon the braking lever exceeds a certain threshold, the hooks 222, 224, and 230 may be urged to decouple. In some embodiments, the braking lever 115 may also include a shock absorber 225 configured to dampen any extreme forces, such as from a fall situation. In such an instance, the decoupling may alone indicate that the locking system 100 has withstood a certain fall situation that requires the locking system 100 to be replaced.

Referring now to FIG. 2B, an example fall situation is shown using a locking system 100 of an example embodiment. In various embodiments and during a fall situation, the engagement member 215 may be configured to rotate such that the engagement member 215 disengages from the braking lever 115 (e.g., disengages from the restriction portion 220 of the braking lever 115), allowing the braking end 210 of the braking lever 115 to rotate and engage with the guide member 200. In some embodiments, the engagement member 215 may be disengaged from the braking lever 115 using the thumb switch 180 shown in FIGS. 1A-1C. Additionally or alternatively, the engagement member 215 may be configured to disengage from the braking lever 115 based on the motion of the locking system 100 along the guide member 200. In some embodiments, the force of the connecting portion 135 on the braking lever 115 may cause the braking lever 115 to rotate and disengage from the engagement member 215. In an instance the engagement member 215 disengages from the braking lever 115 (e.g., the engagement member 215 rotates around point 260), the braking lever 115 may rotate in the downward direction (e.g., counterclockwise as shown from FIGS. 2A and 2B) such that the braking end 210 of the braking lever 115 forcibly engages the guide member 200.

In some embodiments, the locking system 100 may include a spring 280 (e.g., mounted below and sharing a common rotational center with the catch nose component 240 discussed in reference to FIGS. 9A and 9B) to dissipate the rotational force of the braking lever 115 (e.g., to avoid the braking lever from damaging and/or breaking the guide member 200). FIGS. 10A-C show example positions of the spring 280 in various positions of the locking system 100 (e.g., the catch nose component 240 is removed to more clearly view the spring 180). For example, FIG. 10A shows the spring 280 position in an instance the locking system 100 is in the locked position (e.g., in an instance the guide member 200 is in the guide path 160, the braking lever 115 may be engaging the guide member), FIG. 10B shows the spring 280 position in an instance the locking system 100 is in the unlocked position (e.g., in an instance the guide member 200 is in the guide path 160, the braking lever 115 may not engage the guide member and the locking system 100 may travel along the guide member), and FIG. 10C shows the spring 280 position in an instance the locking system 100 is moving towards the guide member installation position (e.g., in an instance the engagement member 215 and the braking lever 115 do not obstruct the guide path 160, such that the guide member 200 may be placed in or removed from the guide path 160). As such and in an instance the locking system 100 is in the unlocked position, the spring 280 and the engagement member 215 may provide resistance to the rotational motion of the braking lever 115. As discussed in more detail in reference to FIGS. 3-4C, as the braking lever 115 engages with the guide member 200, the guide to member 200 may be urged to bend such that the upper end 120 of the housing 130 may also engage with the guide member 200 in addition to the braking lever 115.

In various embodiments and in order to reduce the force on the guide member 200 at the upper end 120 of the housing 130, the housing may be configured with one or more bending slots 110A-C configured to allow the housing 130 to bend or otherwise deform in an instance the force of the guide member 200 on the housing 130 meets a certain force threshold. In some embodiments, the housing 130 may be configured to deform at a predetermined force that is known to not cause an amount of damage to the guide member 200, such as an amount of damage that may lead to a failure of the guide member.

In some embodiments, the housing 130 may be configured to deform at a certain threshold force. For example, the housing 130 may be configured to deform at a force below which the guide member 200 may be rated to withstand. In some embodiments, the housing 130 may be operable with some deformation. In some embodiments, the housing 130 may be operable up until the shock absorber 225 deforms and/or a standard requirement is reached. For example, a standard may require a locking system 100 to be replaced regardless of deformation in an instance a certain force (e.g., 15 kilonewtons) is experienced by the locking system.

Referring now to FIG. 3, a housing 130 is shown. In order to illustrate bending slots 110A-C, housing 130 is illustrated without a curved distal end. That is, housing 130 is shown before the guide path 160 has been formed in accordance with an example embodiment of the present disclosure. In such an embodiment, the housing 130 may be manufactured in a two-step process and may be constructed out of a singular piece of material (e.g., steel or the like), wherein the apertures shown (e.g., bending slots 110A-C and other apertures 175, 235, 250, 260, and 265) are cut and then the guide path 160 is created by bending the housing 130 along the line 300.

In example embodiments, the bending slots 110A-C may be provided at an opposite end of the housing from where a braking lever is configured to contact a guide member. As illustrated in FIG. 3, the bending slots 110A-C are thus positioned near the upper end 120 of the housing 130.

FIG. 3 illustrates three bending slots 110A-C of variable length. In various embodiments, the number of bending slots 110A-C may depend on the amount of deformation desired and/or the amount of force anticipated during a fall situation (e.g., to based on the anticipated weight of a user that may be attached to the system). As such and in some example systems, there may be two or fewer slots whereas in alternative systems there may be four or more slots. Alternatively or additionally, other mechanisms, such as a material that is configured to deform under a force, different thicknesses of materials, and/or the like may be used instead of the bending slots 110A-C to enable the deformation of the housing.

In some examples, the length of the bending slots 110A-C may differ from one another. For example, the top bending slot 110A may be longer than the middle bending slot 110B, which may also be longer than the bottom bending slot 110C. In some embodiments, the length of the bending slots 110A-C may be based on the amount of deformation desired. For example, more deformation may be allowed near the upper end 120 (e.g., where the top bending slot 110A is located) than lower on the housing 130 (e.g., where the middle bending slot 110B and/or the bottom bending slot 110C). Additionally, the height of the bending slots 110A-C and the distance between the bending slots 110A-C may depend on the amount of deformation desired and/or the amount of force anticipated during a fall situation. For example, the bending slots 110A-C may be 2 millimeters high to achieve the desired deformation. In some embodiments, the bending slots 110A-C may be an indention into the housing 130 and not a through hole. Such embodiments, may require additional bending slots to allow for similar deformation (e.g., in an instance the bending slots 110A-C are through-holes, the deformation of the housing may be greater than similar sized indentions).

Figure 4A:
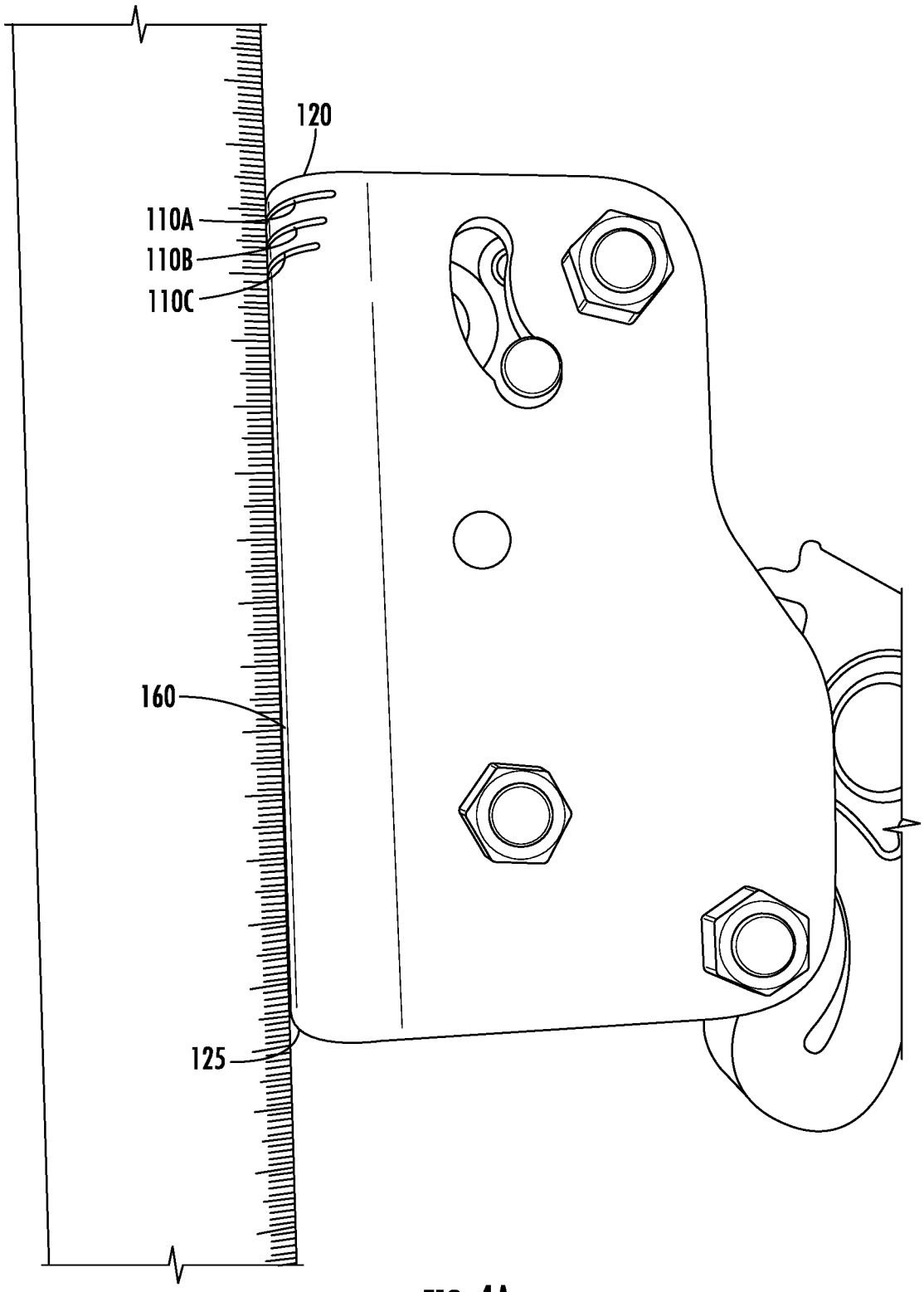

FIGS. 4A-4E illustrate different deformations of the housing 130 of an example embodiment in instances in which the locking system 100 is subject to various amounts of force. The forces discussed in reference to FIGS. 4A-4E are simulated loads upon the connecting portion 135 (e.g., a downward force in the vertical direction, such as that of a user during a fall situation). In an example embodiment, the height of a non-deformed housing (e.g., from the upper end 120 to the lower end 125) may be 115 millimeters. In various embodiments, the size of the housing 130 may be based on the use case (e.g., the size of the guide member 200, size of the load, or the like). FIG. 4A shows the deformation of the housing 130 in an instance in which the locking system 100 has experienced a maximum force of 6 kilonewtons. As shown, the amount of deformation as a result of the 6 kilonewton force is minor as the reference line (e.g., the ruler) is in contact with the housing and remains in contact with and substantially parallel to the housing. In such an instance, the locking system 100 may be used again.

Figure 4B:
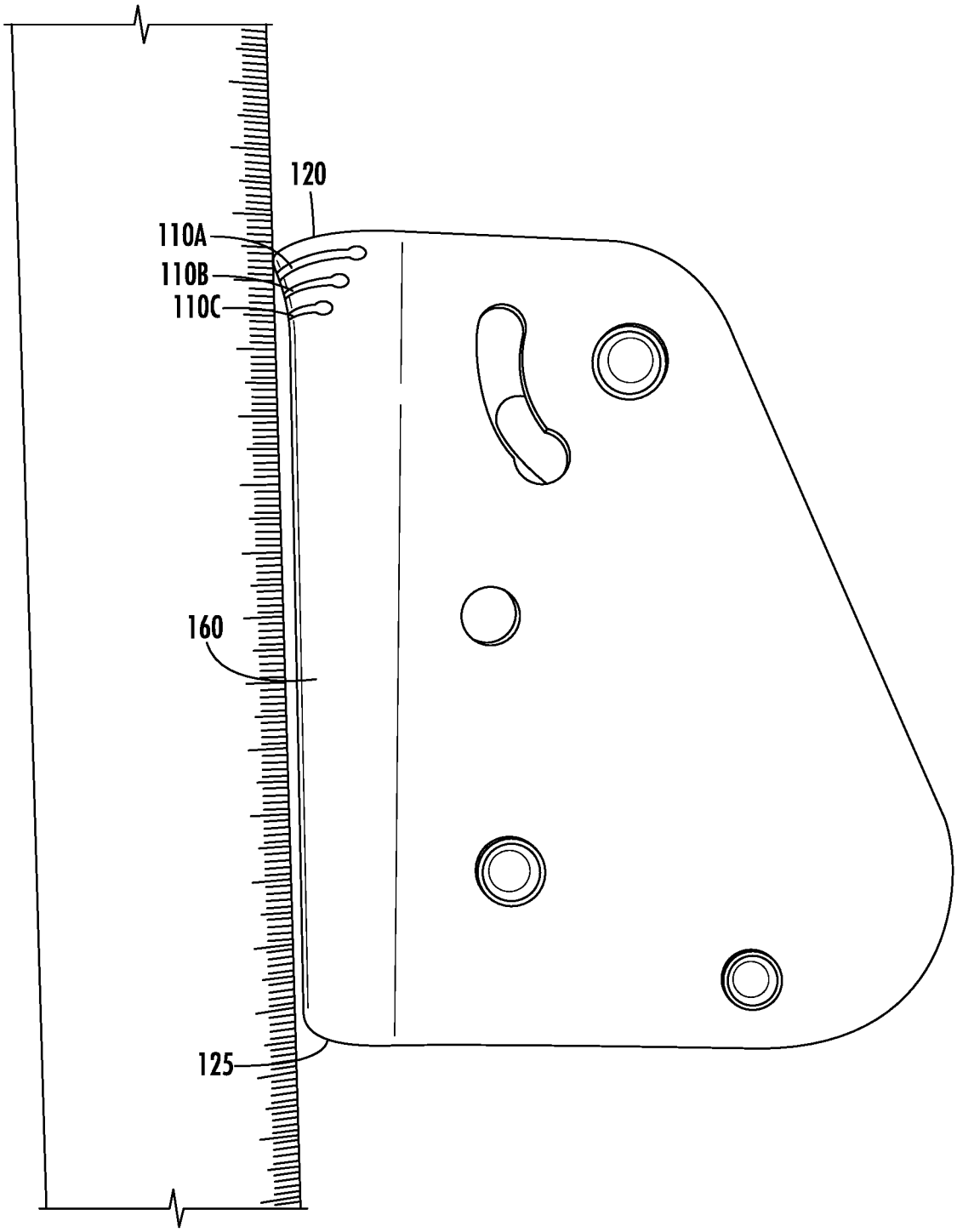
Figure 4C:
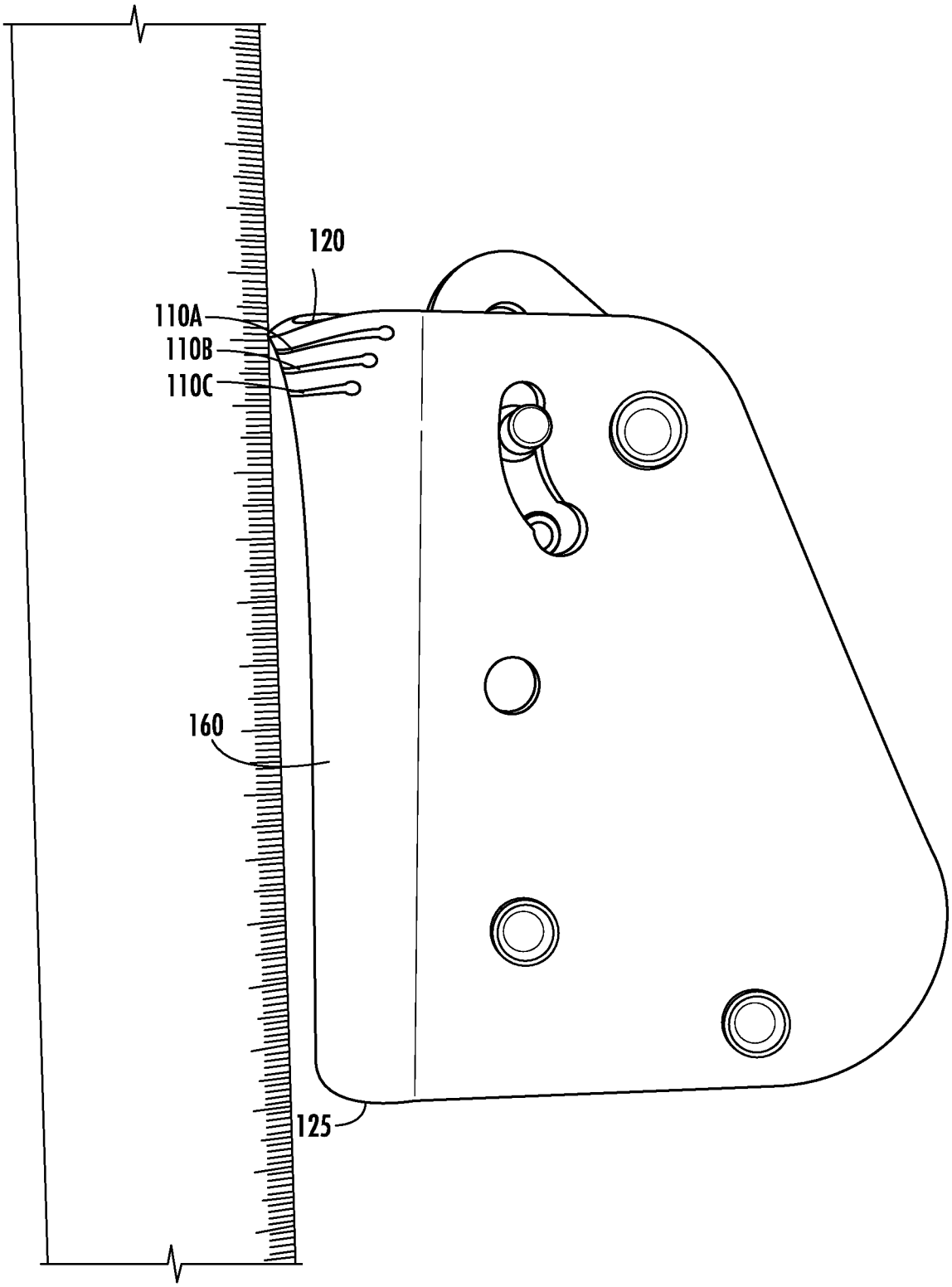

As shown in FIGS. 4B and 4C, as the force increases (16 kilonewtons for FIG. 4B and 18 kilonewtons for FIG. 4C), the amount of deformation along the upper end 120 of the housing 130 increases, such that at least some of the force against the guide member 200 during a fall situation is dissipated. For example, in FIG. 4B, the amount of deformation as a result of the 16 kilonewton force is distinctive as the reference line (e.g., the ruler) is in contact with the housing that the top, but is no longer in contact with or longer substantially parallel to the housing. Additionally, the height of the guide path 160 of the housing 130 (e.g., as shown by the ruler) has decreased from the 6 kilonewton force (FIG. 4A) to the 16 kilonewton force (FIG. 4B), showing more deformation.

Likewise, in FIG. 4C, the amount of deformation as a result of the 18 kilonewton force is distinctive as the reference line (e.g., the ruler) is in contact with the housing that the top, but is no longer in contact with or longer substantially parallel to the housing. Additionally, the height of the guide path 160 of the housing 130 has further decreased in the 18 kilonewton force example (FIG. 4C) than the 16 kilonewton force example (FIG. 4B).

Figure 4D:
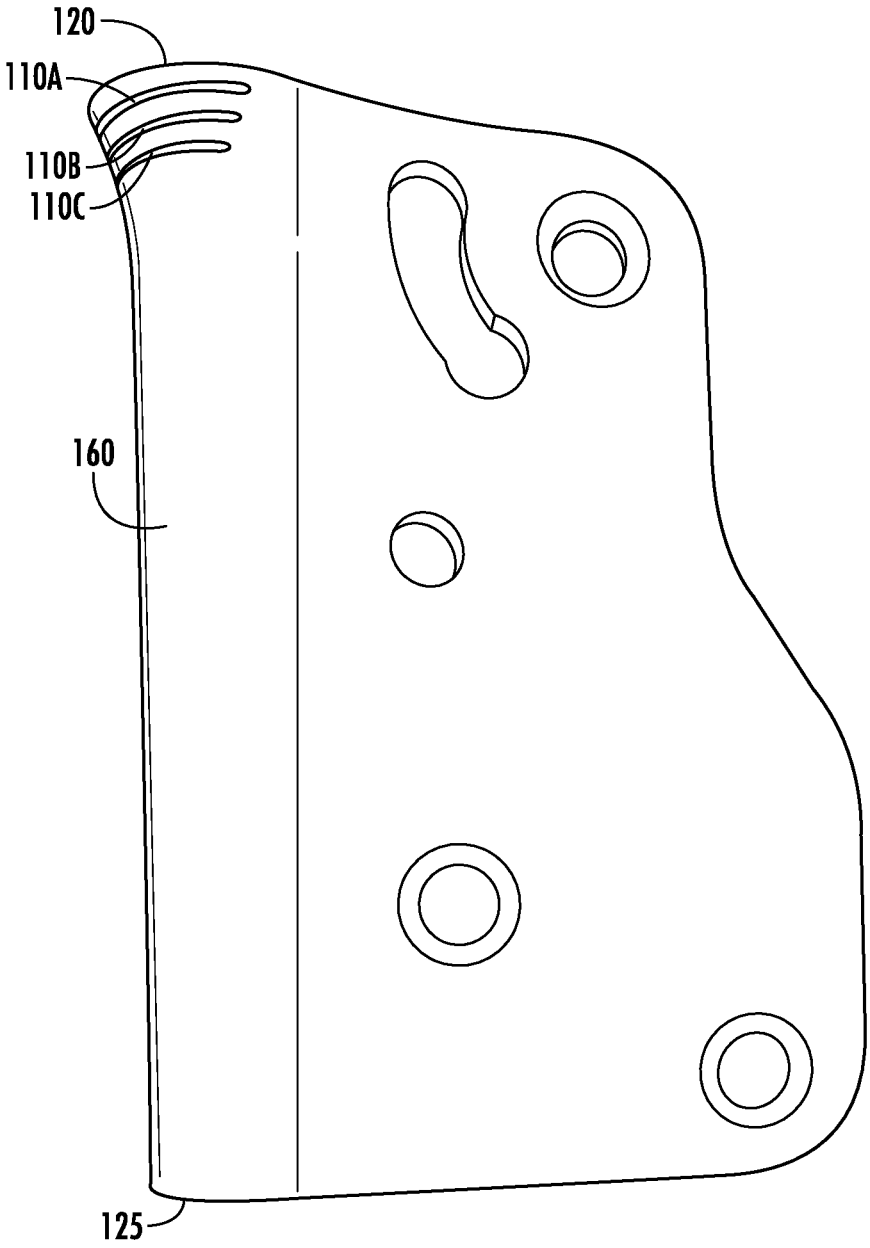
Figure 4E:
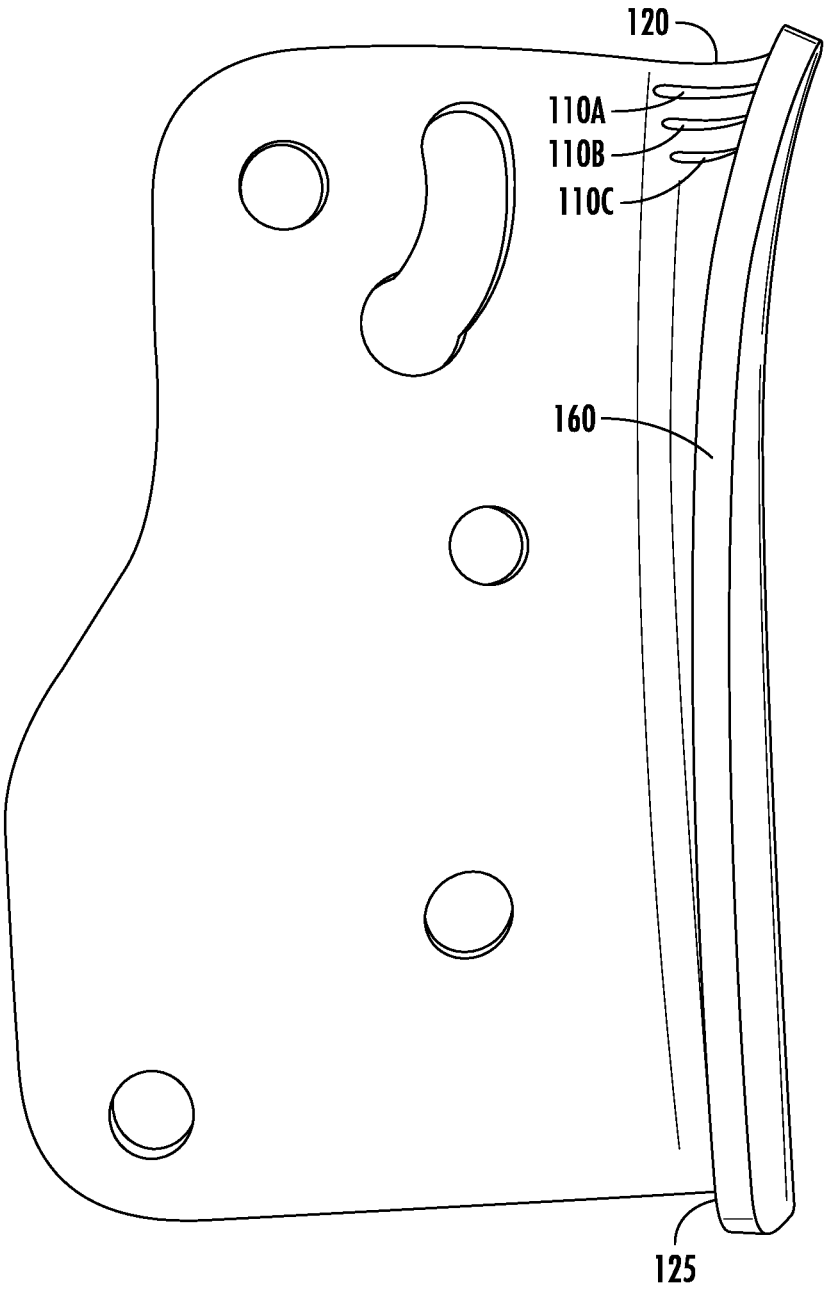

FIGS. 4D and 4E illustrate both sides of the housing 130 in an instance the locking system 100 withstands a 25 kilonewton force. As shown, the upper end 120 of the guide path 160 is much more deformed when compared to the deformation shown in FIGS. 4A-4C where the housing experienced lesser force. Additionally, while the upper end 120 of the guide path 160 deforms, the deformation may be generally localized near the guide path 160, such that there may be little to no deformation of the upper end 120 closer to the proximal end of the housing 130.

FIG. 5 shows the internal markings of the guide path 160 in an instance the guide member 200 engages with the upper end 120 of the housing 130. In such an embodiment, the guide member 200 (e.g., a metal cable) may also physically alter the guide path 160 in addition to the deformation discussed above. Based on the amount of deformation of the housing 130, the locking system 100 may need to be replaced. In some embodiments, as discussed below, the shock absorber 225 of the braking lever 115 may also permanently deform before the housing 130 deforms such that it has to be replaced.

FIG. 6 illustrates the shock absorber indicator 600 of an example embodiment. As shown, the shock absorber 225 has a first arrow 610 and a second arrow 620 configured such that in an instance the shock absorber 225 has not been permanently deformed, the arrows will line up with one another. In an instance the shock absorber 225 has permanently deformed as discussed below, the first arrow 610 and the second arrow 620 will not line up as a result of the deformation and/or otherwise uncoiling of the shock absorber 225. In various embodiments, the shock absorber indicator 600 may be visible without disassembling the device, such that it can easily be determined by a user whether a locking system 100 has been permanently deformed. Additionally, as shown in FIG. 6, the locking system 100 may include a radio-frequency identification (RFID) sensor 630 configured for tracking the locking system 100 (e.g., to track locking systems that are permanently deformed and/or to provide an indication of a fall situation).

Referring back to FIGS. 2A and 2B, the shock absorber 225 of the braking lever 115 is illustrated before a fall situation and/or before any deformation occurs. In some embodiments, the shock absorber 225 of the braking lever 115 may be created by coiling or bending the braking lever 115 upon itself and using various hooks (e.g., hooks 222, 224, and 230) to hold the shock absorber 225 together during typical operation. As the shock absorber 225 begins to withstand a load from the connecting portion 135 (e.g., a downward force in an instance a fall situation is occurring), the shock absorber 225 may begin to deform. In various embodiments, the force applied is considered to be a downward force upon the connecting portion 135 and does not necessarily include any horizontal forces. In some embodiments, the shock absorber 225 may also deform in an instance a horizontal force is applied. In some embodiments, the shock absorber 225 may be configured to withstand more vertical (e.g., downward) force than horizontal force.

FIG. 7 shows a graph of deformation of the shock absorber 225 in example embodiments. The graph of FIG. 7 is illustrative of the staggered deformation of the shock absorber 225 and the threshold forces of deformation are merely examples and may be different based on the size of the shock absorber 225, the material of the shock absorber 225, or the like. As shown, circle 700 illustrates the range of forces that the first hook 222 may disengage with the rest of the shock absorber 225. In some embodiments, the first hook 222 may disengage from the rest of the shock absorber 225 at 2 kilonewtons to 6 kilonewtons force, preferably 2 kilonewtons to 5 kilonewtons force, and more preferably at 4 kilonewton force. In an instance the first hook 222 disengages, the shock absorber 225 may be considered permanently deformed and therefore require replacement. As the force increases, the second hook 230 may disengage from the rest of the shock absorber 225 (e.g., as shown by circle 710). In some embodiments, the second hook 230 may disengage from the rest of the shock absorber 225 at 4 kilonewtons to 8 kilonewtons force, preferably 5 kilonewtons to 7 kilonewtons force, and more preferably at 6 kilonewtons force. Additionally, as the force continues to increase, the third hook 224 may disengage from the rest of the shock absorber 225 (e.g., as shown by circle 720). In some embodiment, the third hook 224 may disengage from the rest of the shock absorber 225 at 7 kilonewtons to 11 kilonewtons force, preferably 8 kilonewtons to 10 kilonewtons force, and more preferably at 9 kilonewtons force. FIGS. 8A and 8B illustrate permanent deformation of the shock absorber 225 in an instance all three hooks 222, 230, and 224 are disengaged and the shock absorber 225 is completely uncoiled.

FIGS. 9A-9B illustrate an inversion prevention function of a locking system 100 in accordance with an example embodiment, such that the locking system 100 may not be installed on the guide member 200 upside down. As shown, the catch nose component 240 may function as a catch nose that may be configured to block the guide path 160 with either a first catch nose 900 (FIG. 9A) or a second catch nose 910 (FIG. 9B). FIG. 9A shows an instance in which the guide path 160 is blocked by the first catch nose 900. In an instance that the locking system 100 is configured to allow the guide member 200 to be inserted into the guide path 160, the catch nose component 240 may be shaped such that the catch nose component 240 rotates in an instance the locking system 100 is being installed upside down. FIGS. 9A and 9B show two examples of the catch nose component 240, one in which the second catch nose 910 engages the braking lever 115 (FIG. 9A) and one in which the second catch nose 910 does not engage the braking lever 115 (FIG. 9B).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A locking system for fall protection, the locking system comprising:

a housing, wherein the housing defines a guide path through which the housing is slideably attached to a guide member; and a braking lever having a braking end, wherein the braking lever is configured to rotate so as to allow the braking end to engage the guide member, wherein the guide path defines at least one bending slot configured to allow the housing to deform in response to a predetermined amount of force being applied by the guide member upon the housing.

2. The locking system of claim 1, wherein the guide path defines an upper end and a lower end, wherein the at least one bending slot is positioned proximate to the upper end of the guide path.

3. The locking system of claim 2, wherein in an instance the guide member exerts a predetermined force against the upper end of the guide path, the upper end of the guide path is configured to deform.

4. The locking system of claim 1, further comprising an engagement member configured to restrict the motion of the braking lever in an instance the locking system is in an unlocked position.

5. The locking system of claim 1, wherein the braking lever further comprises a shock absorber configured to dissipate force applied to the locking system.

6. The locking system of claim 5, wherein the shock absorber is configured to permanently deform at a given threshold force.

7. The locking system of claim 6, wherein the shock absorber comprises coiled material coupled together with one or more hooks, such that each of the one or more hooks is configured to withstand a predetermined force at which the hook decouples.

8. The locking system of claim 7, wherein the shock absorber comprises three hooks configured to operable couple with another portion of the shock absorber, wherein each hook is configured to decouple from the other portion of the shock absorber at different forces.

9. A housing for a locking system for fall protection, the housing comprising:

a guide path with an upper end and a lower end, wherein the guide path is configured to be slideably attached to a guide member, wherein the guide path defines at least one bending slot configured to allow the housing to deform at a predetermined amount of force from the guide member.

10. The housing of claim 9, wherein the at least one bending slot is positioned closer to the upper end of the guide path than the lower end.

11. The housing of claim 9, wherein in an instance the guide member exerts a predetermined force against the upper end of the guide path, the upper end of the guide path is configured to deform.

* * * * *